US008328391B2

(12) United States Patent
Snijder et al.

(10) Patent No.: US 8,328,391 B2
(45) Date of Patent: Dec. 11, 2012

(54) LIGHTING MODULE

(75) Inventors: Pieter Jacob Snijder, Eindhoven (NL); Anthonie Hendrik Bergman, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 376 days.

(21) Appl. No.: 12/096,035

(22) PCT Filed: Nov. 29, 2006

(86) PCT No.: PCT/IB2006/054506

§ 371 (c)(1), (2), (4) Date: Jun. 4, 2008

(87) PCT Pub. No.: WO2007/066260

PCT Pub. Date: Jun. 14, 2007

(65) Prior Publication Data

US 2008/0285280 A1 Nov. 20, 2008

(30) Foreign Application Priority Data

Dec. 7, 2005 (EP) ..... 05111779

(51) Int. Cl.
*F21S 4/00* (2006.01)
*G09F 13/04* (2006.01)

(52) U.S. Cl. ..... 362/249.02; 362/249.15; 362/97.3; 349/61; 349/62; 349/64

(58) Field of Classification Search ..... 362/97.2–97.3; 349/61–64, 66
See application file for complete search history.

(56) References Cited

U.S. PATENT DOCUMENTS

| | | | | |
|---|---|---|---|---|
| 3,922,072 | A | 11/1975 | Rogers | |
| 2004/0022058 | A1 | 2/2004 | Birrell | |
| 2005/0138852 | A1 * | 6/2005 | Yamauchi | 40/582 |

FOREIGN PATENT DOCUMENTS

| | | | |
|---|---|---|---|
| EP | 0279386 | A1 | 8/1988 |
| EP | 1496488 | A1 | 1/2005 |
| JP | 02040687 | A | 2/1990 |
| JP | 2000321574 | A | 11/2000 |
| WO | WO8201930 | A1 | 6/1982 |
| WO | WO2005047764 | A1 | 5/2005 |
| WO | WO 2005111496 | A1 * | 11/2005 |

* cited by examiner

*Primary Examiner* — Diane Lee
*Assistant Examiner* — Sean Gramling
(74) *Attorney, Agent, or Firm* — John F. Salazar; Mark L. Beloborodov

(57) ABSTRACT

This invention relates to a lighting module (101) comprising a carrier (103), a plurality of LED groups (109), arranged in an array on the carrier (103), a mesh (105), arranged at the carrier (103), and a front diffuser plate (107) arranged in front of the mesh (105). The mesh (105) has walls, which are arranged in a geometrical pattern forming a plurality of cells (113), such that the light emitted from at least some of the LED groups, which are adjacent to each other, is mixed before passing the diffuser plate.

8 Claims, 3 Drawing Sheets

LIGHTING MODULE

FIELD OF THE INVENTION

The present invention relates to a lighting module comprising a carrier, a plurality of LED groups, each group consisting of at least one LED, arranged in an array on the carrier, a mesh, arranged at the carrier, and a front diffuser plate arranged in front of the mesh.

BACKGROUND OF THE INVENTION

LED based lighting modules are often employing multiple high-brightness LEDs, which are arranged in a regular pattern on a flat carrier. For instance, such a pattern may be a circular or orthogonal array. Often a uniform light distribution is required, and then the LED array is covered by a light diffuser plate arranged at some distance of the LED array in the direction of an observer. The whole lighting module is then regarded as one pixel. However, in some applications it would be desirable to be able to obtain a sub-pixeled lighting module having sub-pixels, being separated from each other. This has been obtained by arranging a mesh of walls, which form cells, on the LED carrier. The diffuser plate is mounted on top of the mesh. Thereby separate chambers, each surrounding a LED or LED group, e.g. an RGB LED group, are formed. However, these prior art lighting modules have a low resolution.

It is often desirable to generate a complex light pattern or a complex scale of colors. Then high resolution lighting tiles having a large number of LED groups densely packed on the carrier and a small cell mesh would be required.

SUMMARY OF THE INVENTION

It is an object of the present invention to provide a lighting module, which has a plurality of sub-pixels and which provides an ability to operate complex light patterns without requirement of high resolution lighting modules.

This object is achieved by a lighting module according to the present invention as defined in claim 1.

The invention is based on an insight that by letting the light be mixed in the optical path and before passing the diffuser plate, light effects comparable to those ordinary obtainable only by means of a high resolution lighting module are obtainable by means of a low resolution lighting module.

Thus, in accordance with an aspect of the present invention, there is provided a lighting module comprising a carrier, a plurality of LED groups, each group consisting of at least one LED, arranged in an array on the carrier, a mesh, arranged at the carrier, and a front diffuser plate arranged in front of the mesh. The mesh comprises first walls, which are arranged in a geometrical pattern forming a plurality of cells, such that the light emitted from at least some of the LED groups, which are adjacent to each other, is mixed before passing the diffuser plate.

By permitting leakage of light from one cell to another, it is possible to provide additional color mixing, diffused transitions between pixels, etc. The arrangement of the walls can be almost infinitely varied, and consequently so can the degree of mixing. Thereby various light effects are obtainable.

In accordance with an embodiment of the lighting module, as defined in claim 2, the mixing is obtained by providing translucent walls.

In accordance with an embodiment of the lighting module, as defined in claim 3, the mixing is obtained by placing the diffuser plate at a distance from the wall edges facing the diffuser plate. Thereby a gap is obtained through which LED light can pass to mix with light from a neighboring LED group.

In accordance with an embodiment of the lighting module, as defined in claim 4, the mixing is obtained by dividing the emitted light in two or more parts. Thus, the parts belong to different cells, where they may be mixed with light emitted by other LED groups.

In accordance with an embodiment of the lighting module, as defined in claim 5, it is easy for a user of the lighting module to change light patterns merely by exchanging the mesh.

In accordance with an embodiment of the lighting module, as defined in claim 7, even more advanced light patterns are possible to achieve.

These and other aspects, features, and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF PREFERRED EMBODIMENTS

Figure 1:
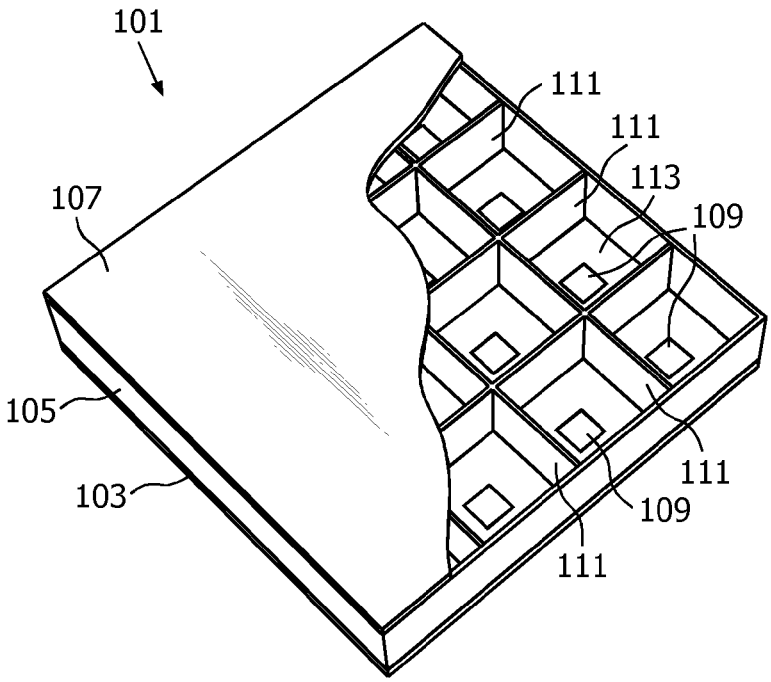
FIG. 1 schematically shows a perspective, partly cut-off, view of a first embodiment of a lighting module according to the present invention.

Referring to FIG. 1 a first embodiment of a lighting module 101 comprises a LED carrier 103, a mesh 105, a diffuser plate 107, and LED groups 109. The LEDs 109 are arranged on a front surface of the LED carrier 103. More particularly the carrier 103 is a substrate and the LEDs 109 are manufactured on the substrate by means of any appropriate known technique. The mesh 105 is mounted at the front surface of the carrier 103, and is constituted by orthogonal walls 111, standing up from the front surface of the carrier 103. The walls form, i.e. define, square cells 113. Each cell 113 contains a LED group 109, which is located at the center of the cell 113, at a maximum distance from the walls, or wall portions, 111 surrounding it. Thus, each cell can be regarded as a pixel in the total image, or light pattern, that is represented by the lighting module 101. Often several lighting modules 101 are used as building tiles in a larger arrangement, where the thus combined lighting module images form a larger whole. The diffuser plate 107 is mounted on top of the mesh 105, and more particularly it is engaged with front edges of the walls 111. Thereby the diffuser plate 107 covers the cells 113 forming a roof thereof. The walls 111 are translucent.

When the LED groups 109 are emitting light, due to the translucency of the walls 111, the light of each LED group 109 is partly separated from the light of adjacent, or neighboring LED groups 109, and partly mixed with the light of the adjacent LED groups 109. As a consequence there will be no distinct borders between the pixels of the image. Instead diffuse transitions will occur, generating, for example, a blurred impression.

Figure 2:
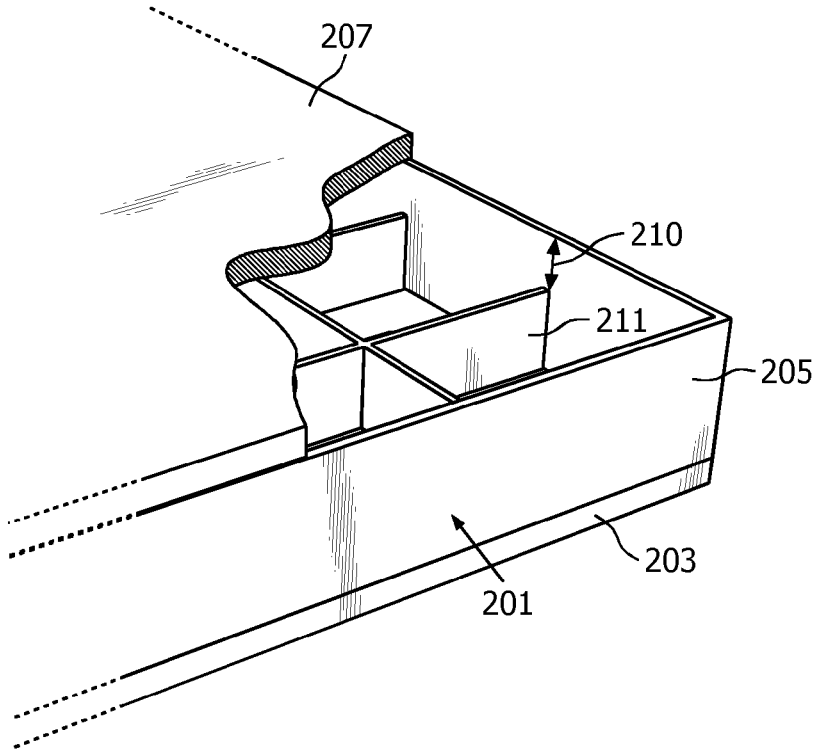
FIG. 2 schematically shows a perspective, partly cut-off, view of a second embodiment of a lighting module according to the present invention.

Referring now to FIG. 2 a second embodiment of alighting module 201, similar to the first embodiment, has a carrier 203, a mesh 205, and a diffuser plate 207. However, the mesh is different in that only the outer walls 211, forming the circumference of the lighting module 201, are full height walls, i.e. the diffuser plate 207 is supported by these walls alone. All other walls 211 are lower, leaving a gap 210 between the front, or top, edges thereof and the diffuser plate 207.

Consequently, emitted LED light from adjacent cells gets mixed to an extent before entering the diffuser plate 207. The mixing can be controlled by the width of the gap 210 as well as the degree of translucency of the walls. Thus, generally, the walls' ability to pass light may range from zero, in combination with the described gap or some other mixing property as will be further described below, to fully transparent, although a modest translucency is often preferred.

For example, alternatively, the lower walls 211 may be non-translucent while the full height walls may be translucent, in order to obtain about the same degree of mixing of light originating from adjacent cells of different neighboring lighting modules 201 as of light from adjacent intra module cells.

Figure 3:
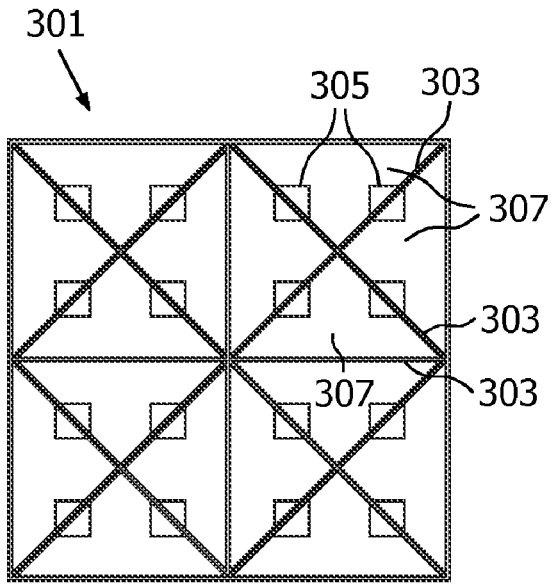
FIG. 3 schematically shows a plan view of a third embodiment of a lighting module according to this invention.

Referring now to FIG. 3, a third embodiment of a lighting module 301 is shown from above, wherein the diffuser plate has been removed. According to this third embodiment the mesh walls 303 are full height walls but they are positioned on top of the LED groups 305. The walls 303 run across the LED groups, such that they divide each LED group 305 in two portions wherein the portions reside in different cells 307. Thus, for example, for a LED group divided in two portions, one part of the emitted light is emitted via one cell 307 and the other part is emitted via another, adjacent, cell 307. Further, the mesh walls 303 are arranged such that each cell 307 enclose two parts of different LED groups 305. Consequently, light emitted from different LED groups 305 is mixed within each cell 307. The mesh can be seen as constituted by walls 303 forming an outer square, walls 303 forming an X, wherein each end of the walls is engaged with a different corner of the outer square, and a smaller copy of this arrangement inscribed therein and rotated 45 degrees relative to the larger arrangement.

This wall arrangement results in triangular cells as an alternative to the square cells of the embodiments described above. With these triangles even more compositions of light patterns are possible.

Figure 4A:
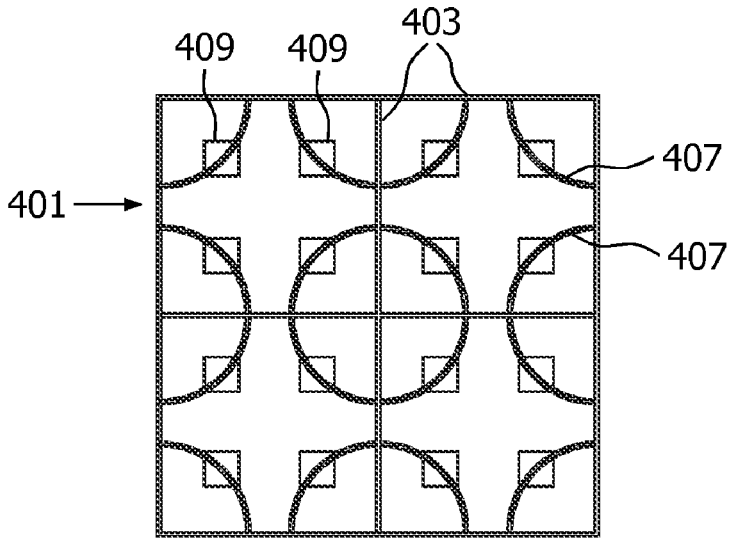
FIGS. 4*a* and 4*b* schematically show a plan view and a perspective view of a mesh employed by a fourth embodiment of a lighting module according to this invention.
Figure 4B:
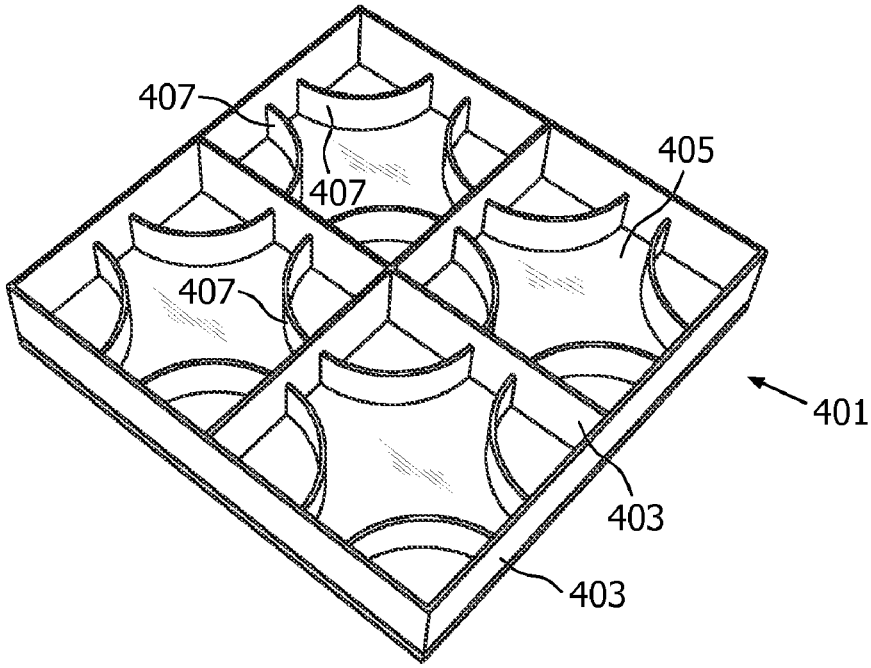

Referring now to FIGS. 4*a* and 4*b* a fourth embodiment of the lighting module 401 comprises a mesh having first walls 403 of full height, i.e. extending from the front, or top, surface of the substrate 405 to the back surface, or underside, of the diffuser plate, and second walls 407 of half the height of the first walls 403. The first walls 403 are straight and form square cells. The second walls 407 are arc shaped. Each one of the second walls 407 extend between perpendicular wall sections of the first walls defining a cell, and form a sub-cell within the cell. Within each cell there are one or more LED groups, preferably RGB tripleds. In the embodiment shown in FIG. 4*a* and 4*b*, the cells are square, there are four LED groups 409 in each cell, and there are four arc shaped walls 407, located at different corners of the cell. Each LED group 409 is positioned such that a respective arc shaped wall 407 divides the light-emitting surface in two portions, one on each side of the wall 407. Thereby, by means of the second walls 407, for example, shading-shading effects are obtained.

Figure 5:
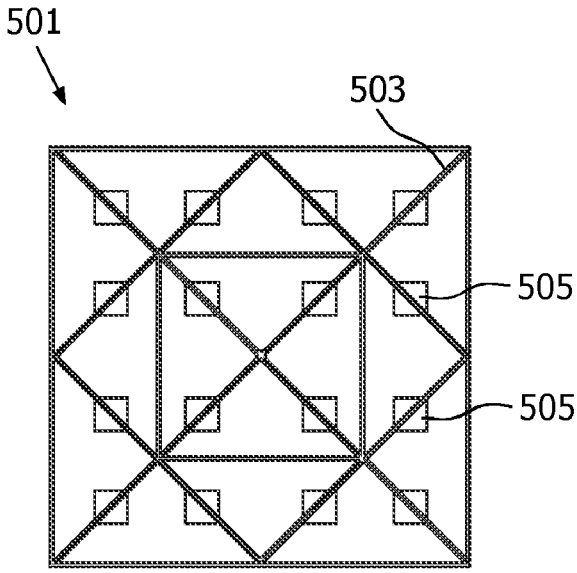
FIG. 5 schematically shows a plan view of a fifth embodiment of a lighting module according to this invention.

A fifth embodiment 501 of the lighting module is shown in FIG. 5. It is similar to the third embodiment. The only difference is that some of the walls 503 are differently arranged. The wall still divides the light output of the LED groups 505 in two parts. The walls can be seen as comprised of an outer square, an intermediate square, inscribed in, and rotated 45 degrees relative to, the outer square, such that the corners of the intermediate square engage the walls of the outer square at the middle thereof. Further, an inner square is inscribed in the intermediate square and rotated 45 degrees relative to the intermediate square. Finally two walls constitute an X extending between respective diagonal corners of the outer square.

All the different ways of achieving a controlled light mixing, described above, can be combined in one and the same lighting module, if desired.

Above, embodiments of the lighting module according to the present invention have been described. These should be seen as merely non-limiting examples. As understood by a skilled person, many modifications and alternative embodiments are possible within the scope of the invention.

Thus, as explained by means of the embodiments above, by making mesh wall arrangements that causes the emitted light from different LED groups mix before reaching the diffuser, unexpectedly complex light effects are obtainable.

It is to be noted, that for the purposes of this application, and in particular with regard to the appended claims, the word "comprising" does not exclude other elements or steps, that the word "a" or "an", does not exclude a plurality, which per se will be apparent to a person skilled in the art.

The invention claimed is:

1. A lighting module, comprising:

a carrier, a plurality of LED groups, each of said plurality of LED groups consisting of at least one LED generating emitted light, arranged in an array on the carrier, the plurality of LED groups includes at least a first LED group and a second LED group adjacent to each other;

a non-reflective translucent mesh, arranged at the carrier, and a front diffuser plate arranged in front of the mesh, wherein said mesh includes first walls which are arranged in a geometrical pattern forming a plurality of adjacent cells, said first walls being translucent and allowing light to pass through to adjacent cells through said first walls for mixing before passing through said diffuser plate;

wherein each of said adjacent cells includes one of said plurality of said LED groups; such that said light emitted from the first LED group is partly separated and partly mixed with said light emitted from the second LED group, and wherein said emitted light from said LED groups is mixed in adjacent cells before passing through said diffuser plate.

2. A lighting module according to claim 1, wherein there is a gap between an upper edge of at least one of said walls and the diffuser plate.

3. A lighting module according to claim 1, wherein at least one of said walls is arranged such that the wall divides the light emitted from a LED group adjacent to the wall.

4. A lighting module according to claim 1, wherein said mesh is exchangeable.

5. A lighting module according to claim 1, wherein each cell forms walls encircling at least a part of a LED group.

6. A lighting module according to claim 5, wherein second walls are arranged within at least one of the cells.

7. A lighting module according to claim 6, wherein said second walls have a lower height than said first walls.

8. A lighting module, comprising:

a substrate supporting a plurality of LED groups, each of said LED groups including at least one LED;

said substrate supporting a non-reflective mesh extending upwards therefrom;

wherein said mesh includes first walls arranged in a geometrical pattern forming a plurality of adjacent cells;

a diffuser plate supported by said mesh in opposing relationship to said plurality of LED groups;

second walls extending upwards from said substrate towards said diffuser plate and extending across said adjacent cells;

wherein said second walls run across said plurality of LED groups dividing said plurality of LED groups into a first and a second portion, said first and said second portion of said divided LED group being in different adjacent cells formed by said first and said second walls;

said first and second walls being translucent and allowing light to pass through to adjacent cells through said first and said second walls for mixing before passing through said diffuser plate.

* * * * *